United States Patent [19]

St. Louis

[11] 4,224,003

[45] Sep. 23, 1980

[54] BACKHOE MOUNTED VIBRATING PLATE SOIL COMPACTOR

[75] Inventor: Paul T. St. Louis, Littleton, Colo.

[73] Assignee: Construction Technology, Inc., Denver, Colo.

[21] Appl. No.: 971,383

[22] Filed: Dec. 20, 1978

[51] Int. Cl.[2] ..... E01C 19/30

[52] U.S. Cl. ..... 404/133; 74/87; 404/117

[58] Field of Search ..... 404/133, 113, 117, 102; 74/87, 61

[56] References Cited

U.S. PATENT DOCUMENTS

| | | | |
|---|---|---|---|
| 2,643,595 | 6/1953 | Jackson | 404/113 |
| 3,128,682 | 4/1964 | Thompson | 404/113 |
| 3,561,336 | 2/1971 | Century | 404/133 |
| 3,782,845 | 1/1974 | Briggs | 404/133 |
| 3,899,263 | 8/1975 | Briggs | 404/133 |
| 3,917,426 | 11/1975 | Wohlwend | 404/113 X |

*Primary Examiner*—Nile C. Byers, Jr.

*Attorney, Agent, or Firm*—Hubbard, Thurman, Turner, Tucker & Glaser

[57] ABSTRACT

A hydraulically operated vibratory soil compactor adapted for use with a loading boom such as a backhoe. Improved construction includes a rectangular structural steel tube welded to a vibrating base plate for providing: structural reinforcement; a sealed housing for an eccentric weight vibrator; and, a supporting surface for shear type springs or shock mounts. A hydraulic drive motor is also mounted on the outside of the central tube member. Improved construction further includes an I-beam section welded between a pair of inverted U-shaped plates to form a tunnel type mounting frame having four arms for connection to the shock mounts supported on the tube member.

8 Claims, 2 Drawing Figures

BACKHOE MOUNTED VIBRATING PLATE SOIL COMPACTOR

BACKGROUND OF THE INVENTION

This invention relates generally to vibratory compactors and more particularly to improved construction of such compactors.

Vibratory compactors are generally well known and include self-contained units such as that taught by U.S. Pat. No. 3,782,845 issued to Briggs, et al on Jan. 1, 1974, and boom carried hydraulically powered units such as that taught by U.S. Pat. No. 3,917,426 issued to Wohlwend, et al on Nov. 4, 1975. The devices taught by these two patents and numerous other patents cited therein all employ a rotating eccentrically weighted shaft for vibrating a base plate which rides on loose earth, gravel, etc., which is to be compacted. The various known devices differ in the type of motor used to drive the eccentric weighted shaft and in the basic construction of the devices.

Reliability of mechanical devices tends to be improved by reduction in the number of component parts that go to make up the whole device. This reduction in parts typically also reduces the overall cost of the device. But with vibratory compactors, it is, of course, necessary that the device be extremely rugged to withstand its own internally generated vibrations and to withstand the rough treatment which is incident to the construction work in which the devices are used.

The above referenced Wohlwend patent illustrates a concern for ruggedness and a somewhat simplified construction when compared to earlier devices. That patent used two tubular members to hold U-shaped side members in a spaced apart parallel condition. It can be seen that this requires that both tubular members be cut to precisely the same length, that the cut ends be at a precise right angle to the tube axis and that circular welds be made. In addition, the construction of Wohlwend employs four connector plates attached to the four corners of the baseplate for connecting shear springs to the side plates. The vibration motor is separately mounted on the compaction plate. Thus it is seen that the complete unit comprises a fairly large number of separate parts.

SUMMARY OF THE INVENTION

Accordingly, an object of the present invention is to provide an improved vibratory compactor.

Another object of the present invention is to provide a rugged vibratory compactor of simple construction.

A vibratory compactor according to the present invention includes a base plate reinforced by a rectangular structural steel tube and a mounting frame comprising a pair of U-shaped members rigidly connected together by a section of structural steel I-beam. The reinforcing tube is provided with end caps, thereby forming a closed chamber within which an eccentrically weighted shaft is journaled. The sides of the tube are used to mount shear spring elements which are also connected to the arms of the U-shaped mounting frame members.

BRIEF DESCRIPTION OF THE DRAWINGS

The present invention may be better understood by reading the following detailed description of the preferred embodiment with reference to the accompanying drawings wherein.

DESCRIPTION OF THE PREFERRED EMBODIMENT

Figure 1:
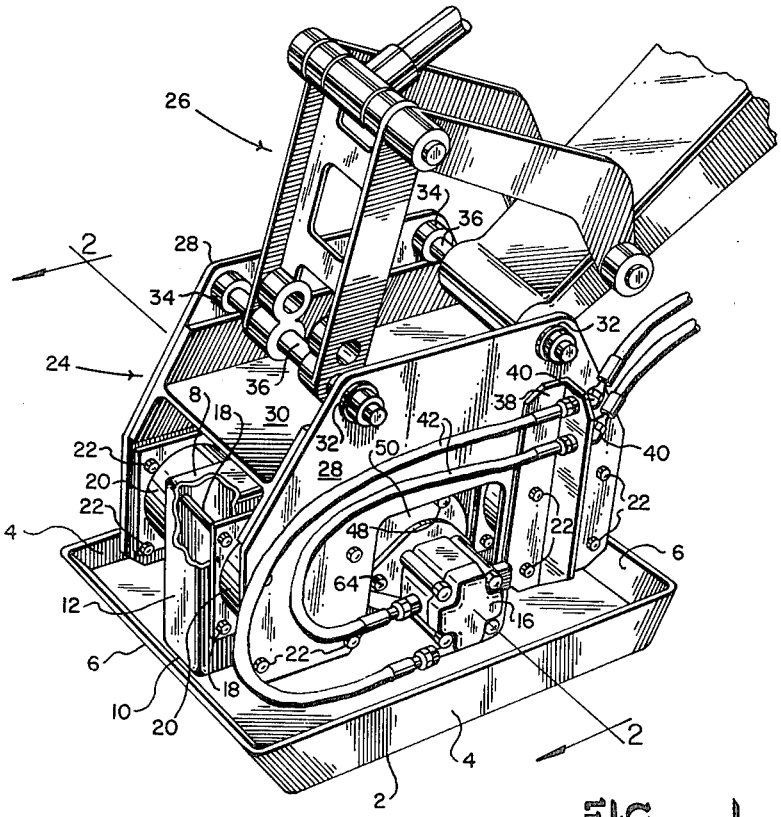
FIG. 1 is a perspective view of a compactor according to the present invention with a portion of a backhoe boom; and, FIG. 2 is a partially cross-sectional view of the structural beam vibration generator portion of the compactor of FIG. 1.

With reference now to FIG. 1, most of the elements of the present invention are illustrated in a perspective view. The assembly of FIG. 1 is supported primarily upon a base plate 2, which in a preferred form, is a steel plate approximately 1½ inches thick, 23 inches wide, and 26 inches long. Base plate 2 is reinforced by vertical side plates 4 and angled end plates 6. In addition, base plate 2 is reinforced by a rectangular structural steel tube 8 which is welded along one of its short sides 10 to the top of base plate 2. Tube 8 is also approximately 26 inches long and is aligned with the long axis of the base plate 2. A pair of end caps, such as cap 12, are welded to the ends of tube 8 to form a closed chamber. Two concentric or aligned apertures 14 (FIG. 2) are provided in the long sides of tube 8 for supporting an eccentrically weighted shaft and bearing assemblies described in detail below with respect to FIG. 2. A hydraulically powered motor 16 is also supported on the outside of tube 8 for rotating the eccentrically weighted shaft.

Holes are also provided through the long sides of tube 8 at each end for bolts 18, which attach four shear spring mounts 20 to the tubular member 8. In the preferred embodiment, the shear springs 20 are conventional elastomeric shear blocks, or shock mounts. The opposite ends of shear springs 20 are connected by bolts 22 to a mounting frame 24 adapted for supporting the vibrator assembly from a backhoe boom 26 (partly illustrated). The mounting frame 24 comprises a pair of essentially identical inverted U-shaped side plates 28 welded to a section of I-beam 30. As illustrated, the opening between the arms of the U-shaped side plates is sufficiently large, in the preferred embodiment about nine inches, to provide room for hydraulic motor 16 and to allow convenient access to the entire vibrator shaft assembly. The I-beam section 30 is positioned with its web portion parallel to base plate 2 and welded along its length to the bight portion of the two U-shaped side plates 28. A pair of holes 32 are provided through the bight portions of the U-shaped side plates 28 above I-beam 30 for accommodating pivot bushings 34 and pivot or mounting pins 36, which link the apparatus to the backhoe boom 26.

Also illustrated in FIG. 1 is a bulkhead bracket 38 which is conveniently mounted on one of the side plates 28 by means of two of the bolts 22. Hydraulic fittings 40 are provided on one side of bulkhead 38 for connection of inlet and return hydraulic fluid lines. Flexible hydraulic hoses 42 are connected to the opposite side of bulkhead 38 and run in a large loop to the inlet and return hydraulic fluid fittings on motor 16. This arrangement of the hoses 42 is quite effective in preventing the hoses from rubbing on other parts of the apparatus and in eliminating the effects of fatigue which might otherwise result from the vibrational motion of the ends of the hoses connected to motor 16.

Figure 2:
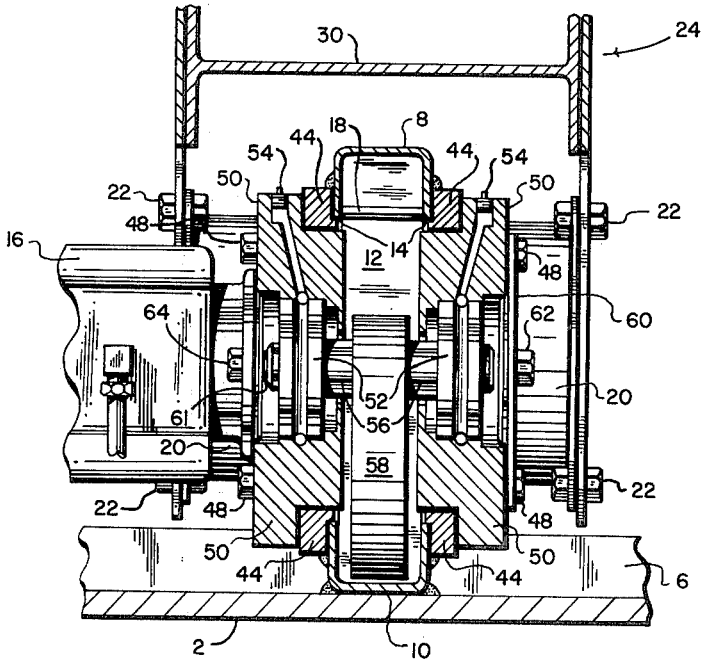

With reference now to FIG. 2, there is illustrated the details of the vibration generator in a partially cross-sectional view taken through member 8 of FIG. 1. Common designation numbers are used for the parts which also appear in FIG. 1. As noted above, a pair of circular apertures 14 are provided through the long sides of tube 8 in opposition to each other. A pair of reinforcing flanges 44 are welded into the apertures 14 to provide proper alignment of bearings and means for bolting the bearings to the assembly. A plurality of threaded holes are provided in flange 44 for receiving bols 48. A pair of bearing cartridges 50 fit within the flanges 44 and are bolted thereto by bolts 48. A pair of bearings 52 are pressed into bearing cartridges 50 and are thereby supported and held in proper alignment. Grease fittings 54 and accompanying passageways through cartridges 50 are provided for lubricating the bearings 52.

A shaft 56 is rotatably supported by bearings 52 with the main part of the shaft located within the tube 8. An eccentric weight 58 is pressed onto shaft 56 before assembly of the unit. Weight 58, in the preferred form, is simply a disc having an off-center hole for receiving shaft 56. Other shapes or single piece structures could, of course, be used. The maximum dimensions of weight 58 are selected so it will fit through flange 44, or at least aperture 14, to facilitate parts replacement and repair.

A cover plate 60 is bolted to one of the bearing cartridges 50 by bolts 62 to protect the corresponding bearing 52. The hydraulic motor 16 is bolted to the opposite bearing cartridge 50 by bolts 64 and has an output shaft 61 which mates with a hollow splined end of shaft 56. It can be seen that this arrangement provides a protective housing within which the shaft 56 and weight 58 may rotate and which also prevents the contamination of bearings 52 by any dust or water which is commonly encountered in construction sites.

The construction of the thus described vibrating compactor has several distinct advantages over previously known compactors. In particular, the use of the I-beam section 30 to interconnect side plates 28 of the mounting frame provides a simple and yet extremely rugged mounting frame structure. The side plates 28 are welded to the flat top and bottom surfaces of I-beam 30 and not to the cut ends of the beam. As a result, the beam itself provides the necessary alignment to insure that side plates 28 are parallel to each other and gives the wellknown strength of the I-beam structure to the mounting frame 24. A second major advantage of the present construction is the use of the structural steel tube 8 for a number of purposes. By being welded along the length of base plate 2, the tube 8 obviously increases the rigidity of base plate 2. In addition, as described above, the tube 8 is the housing in which the vibration generator itself is assembled, thus avoiding the need for a separate housing. Since tube 8 is the central structural member of base plate 2, it is, of course, the ideal means for coupling the vibrational forces to the base plate 2.

In addition, the tube 8 in combination with the mounting frame 24 has been found to provide a very effective placement of the shear spring members 20, which reduce the transmission of vibrational forces from base plate 2 to the mounting frame 24. While some lateral spacing of the shear springs 20 is desirable to resist tilting of the base plate relative to the frame 24, positioning at the extreme outer edges of the base plate, such as taught by Wohlwend, is believed to provide excessive resistance and resulting accelerated wear on the shear springs. The central tube 8 provides strong shear spring mounting surfaces spaced approximately four inches apart, in the preferred embodiment, without the need for providing separate special purpose mounting flanges. Again, since the tube 8 is a central structural member of base plate 2, it is also the ideal location mechanically for connecting the shear springs 20. The four inch spring between the springs 20 allows some tilting of base plate 2 relative to frame 24, which is desirable in most cases to help insure that the base plate 2 lies flat on the ground surface to be compacted. The distortion of springs 20 is minimized under the tilt conditions by the narrow spacing of the mounting surfaces and is ultimately limited by contact of the arms of side plates 28 with the base plate 2.

In operation, the apparatus of the present invention is mounted on a backhoe boom, as illustrated in FIG. 1, and hydraulic fluid input and return lines are connected from fittings 40 to a source of pressurized hydraulic fluid which is preferably the backhoe tractor itself, although an auxiliary pump could be used. The compactor is then positioned on, for example, loose earth by means of the backhoe boom and hydraulic fluid is supplied to the inlet line to drive hydraulic motor 16 and, thereby, the eccentric weight 58. With the apparatus of the present invention, a peak force of about sixty-six hundred pounds has been achieved at twenty-one hundred vibrations per minute. The vibrational rate and peak force is, of course, a function of hydraulic fluid pressure and flow rate and can also be changed by modifying the eccentric weight arrangement.

While base plate 2 has been described as rectangular it could be a perfect square, or its dimensions could be reversed to provide a width greater than the length. In similar manner the rectangular tube 8 could be a perfect square or could have a width greater than its height. It is apparent that other dimensions may be changed and other modifications made within the scope of the present invention as defined by the appended claims.

I claim:

1. A vibrating plate compactor adapted for connection to and use with a loading boom comprising:
- a base plate for engaging a work surface,
- a rectangular structural steel tube having one of a first pair of opposite sides bonded to said base plate, and having opposing centrally positioned apertures in each of a second pair of opposite sides,
- bearing means carried in said apertures,
- a shaft supported by said bearing means including an eccentric weight positioned within said tube,
- a mounting frame comprising a pair of parallel inverted U-shaped plates having arms symmetrically spaced about the second pair of sides of said tube and equally spaced from said base plate, and
- spring means positioned between and attached to the arms of said U-shaped plates and opposing surfaces of said structural steel tube.

2. A compactor according to claim 1 wherein the first pair of opposite sides of said rectangular steel tube are shorter than the second pair of opposite sides.

3. A compactor according to claim 1 wherein:
- said base plate is rectangular having first sides longer than second sides;
- said tube has a length about equal to the length of said first sides of said base plate; and
- said tube is centered between and parallel to said first sides.

4. A compactor according to claim 1 further including end caps bonded to the ends of said structural steel tube to form a sealed enclosure for said bearing means, shaft, and eccentric weight.

5. A compactor according to claim 1 wherein said mounting frame further includes a section of I-beam bonded between said plates to hold said plates in a preselected parallel spaced apart position, wherein the web of said I-beam section is generally parallel to said base plate.

6. A compactor according to claim 1 wherein said spring means comprise shear blocks of elastomeric material.

7. In a vibratory compactor of the type having a work engaging base plate, a rotating eccentric weight vibrator for vibrating said base plate, and a mounting frame coupled to said base plate by shear springs, the improvement comprising:

a rectangular structural steel tube having one of a first pair of opposite sides bonded to the top surface of said base plate, said tube having opposing centrally positioned apertures in each of a second pair of opposite sides, and bearing means supported in said apertures for supporting said rotating eccentric weight within said tube, wherein one end of each of said shear springs is directly connected to the longer sides of said tube.

8. In a vibratory compactor of the type including a mounting frame adapted for connection to a loading boom, a base plate, a vibration generator attached to said base plate, and spring means coupling said base plate to said mounting frame, an improved mounting frame comprising:

a pair of parallel inverted U-shaped side plates each having arm portions adapted for connection to said spring means and a bight portion adapted for connection to said boom, and a section of structural steel I-beam bonded between said side plates to hold said side plates in a preselected parallel spaced apart position, wherein the web of said I-beam is generally parallel to said base plate.

* * * * *